US011080979B2

(12) United States Patent
Barson et al.

(10) Patent No.: US 11,080,979 B2
(45) Date of Patent: Aug. 3, 2021

(54) ALARMING SYSTEM FOR MULTI-UNIT BUILDINGS

(71) Applicant: HONEYWELL INTERNATIONAL INC., Morris Plains, NJ (US)

(72) Inventors: Michael Barson, Morris Plains, NJ (US); Benjamin H. Wolf, Morris Plains, NJ (US); Jeffrey Alan Doggett, Morris Plains, NJ (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/887,337

(22) Filed: May 29, 2020

(65) Prior Publication Data

US 2020/0380838 A1 Dec. 3, 2020

(30) Foreign Application Priority Data

May 31, 2019 (GB) ..... 1907780

(51) Int. Cl.
*G08B 21/02* (2006.01)

(52) U.S. Cl.
CPC ..... *G08B 21/0225* (2013.01); *G08B 21/0205* (2013.01); *G08B 21/0216* (2013.01); *G08B 21/0244* (2013.01)

(58) Field of Classification Search
CPC ..... G08B 17/00; G08B 25/14; G08B 27/003; G08B 17/10; G08B 31/00; G08B 21/0225; G08B 21/0216; G08B 21/0244
USPC ..... 340/628–630, 539.1, 539.16, 577
See application file for complete search history.

(56) References Cited

U.S. PATENT DOCUMENTS 4,531,114 A * 7/1985 Topol ..... A62B 3/00 340/332
4,641,127 A * 2/1987 Hogan ..... G08B 19/00 340/521
5,587,705 A * 12/1996 Morris ..... G08B 7/066 340/326
7,054,414 B2 * 5/2006 Bergman ..... G08B 25/008 379/37

(Continued)

FOREIGN PATENT DOCUMENTS

WO 2018088912 A1 5/2018

OTHER PUBLICATIONS

Combined Search and Examination Report under Sections 17 and 18(3) from related priority application GB1907780.9 dated Oct. 24, 2019 (6 pages).

*Primary Examiner* — Eric Blount
(74) *Attorney, Agent, or Firm* — Brooks, Cameron & Huebsch, PLLC

(57) ABSTRACT

Devices, systems, and methods for an alarming system for multi-unit buildings are described herein. One system includes a number of remote sensors positioned in a building having common areas and individual units occupied by occupants, the remote sensors are provided for sensing an alarm condition, a central control panel located in the common areas of the building for collecting data from the remote sensors, the control panel utilized for analyzing the collected data, determining whether to initiate an alarm, and sending one or more signals to initiate an alarm, if an alarm is to be initiated, and an occupant input device located in at least one individual unit for requesting a delay in initiating the alarm.

19 Claims, 2 Drawing Sheets

(56) References Cited

U.S. PATENT DOCUMENTS

| | | | | |
|---|---|---|---|---|
| 7,109,879 | B2 * | 9/2006 | Stults | G08B 1/08 340/286.06 |
| 7,567,174 | B2 * | 7/2009 | Woodard | G08B 17/10 340/539.13 |
| 7,714,733 | B2 * | 5/2010 | Farley | G08B 27/00 340/628 |
| 8,970,354 | B2 * | 3/2015 | Lewis | G08B 7/066 340/332 |
| 9,454,893 | B1 * | 9/2016 | Warren | G08B 17/10 |
| 2007/0109114 | A1 * | 5/2007 | Farley | G08B 25/085 340/506 |
| 2008/0258924 | A1 * | 10/2008 | Moss | G08B 25/14 340/577 |
| 2010/0302045 | A1 | 12/2010 | Foster | |
| 2012/0068842 | A1 * | 3/2012 | Piccolo, III | G08B 25/14 340/501 |
| 2013/0024800 | A1 * | 1/2013 | Sundriyal | G08B 25/14 715/772 |
| 2014/0266669 | A1 * | 9/2014 | Fadell | H05B 47/10 340/501 |
| 2016/0042638 | A1 * | 2/2016 | Sangha | G08B 29/26 340/628 |
| 2016/0316293 | A1 * | 10/2016 | Klimanis | G10L 21/0208 |
| 2020/0327799 | A1 * | 10/2020 | Barson | G08B 17/10 |

* cited by examiner

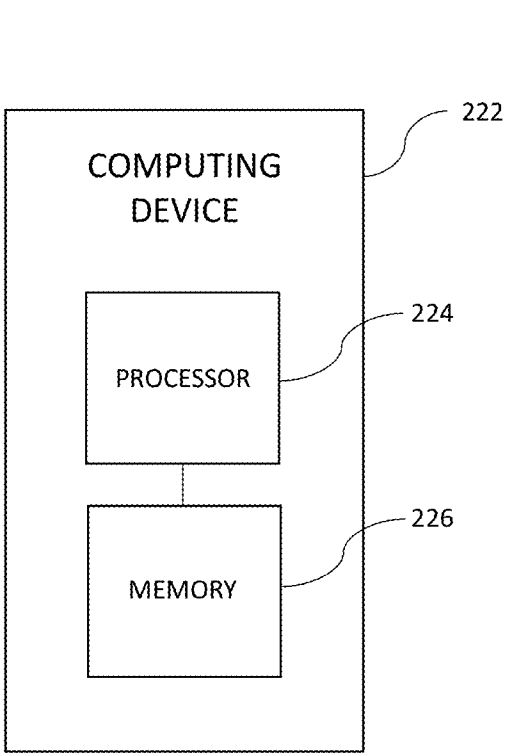
FIG. 2
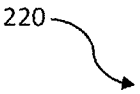

ALARMING SYSTEM FOR MULTI-UNIT BUILDINGS

CROSS-REFERENCE TO RELATED APPLICATIONS

This specification is based upon and claims the benefit of priority from United Kingdom patent application number GB 1907780.9 filed on May 31, 2019, the entire contents of which are incorporated herein by reference.

TECHNICAL FIELD

The present disclosure relates generally to alarming systems for multi-unit buildings.

BACKGROUND

Presently, there are two types of alarming systems for multi-unit buildings (i.e., buildings with multiple areas in which an alarm should be provided to the occupants, like dwellings, such as condo complexes, townhome units within a building, home care facilities, hospitals, or apartment buildings; or commercial buildings, such as strip malls and office buildings). In these types of buildings, the alarm systems are either a unitary system, where when, for example, a fire alarm is actuated, the alarms in the entire building become activated, or an individual system where, for example, each smoke detector may be independent or interlinked only within a local area and when a smoke detector is actuated it does not affect the activation of the alarms in any other area.

Additionally, in a unitary system, deactivation of the system occurs at a centralized control panel that may be outside the area where the initial alarm was initiated and, therefore, if there is not an actual need for an alarm, it is difficult to turn off the system quickly and avoid inconveniencing those occupants that are not proximate to the condition that initially caused the activation of the system. Typically, fire personnel from outside the occupant areas of a building deactivate the alarm at the centralized control panel.

If a unitary system is installed in, for example, an apartment complex, it has been found to be subject to a lot of false alarms (i.e., someone burning their dinner, but there is no fire). These false alarms are inconvenient for the fire fighters responding to the alarm which can drain their resources at times when they may be needed elsewhere. This can also lead to apathy of the occupants, where they do not evacuate the building because they believe all alarms are false. This may lead to unnecessary injuries or deaths when a large fire engulfs a building and the alarms could have prevented the injuries or deaths had the occupants responded quickly when the alarm was initiated.

In contrast, in an individual system, the occupant in the area proximate to the condition that initially caused the activation of the system can turn off the alarm. However, it cannot alert occupants outside of the proximity where the alarm condition exists that a problem that may affect them may be occurring (e.g., a fire on the third floor of an apartment building that may block access to the occupants of floors higher than the third floor).

Each of these types of systems has its advantages in certain implementations. For example, in instances where the entire building needs to be evacuated, a system that has all interconnected devices and all alarms can be activated when one alarm is actuated can be beneficial. Also, in instances where the area where the alarm was initiated is not a common area and may be inaccessible except by the occupants, it may not be possible to turn the alarm off, where in a centralized system, the alarm may be turned off at the centralized control panel.

However, in an apartment complex, when an alarm is activated (e.g., a fire condition that is under control and will not affect the whole building), it may not be beneficial to trigger the alarms in the entire building. Additionally, in situations where a false alarm is initiated (i.e., someone over cooks their dinner and it triggers a smoke alarm, but there is no fire), an independent system can initiate an alarm in the area proximate to the condition causing the alarm, but not inconvenience the other occupants and can allow the occupants proximate to the alarm condition to turn the alarm off. As described above, however, there are instances where neither system is adequate for the implementation.

BRIEF DESCRIPTION OF DRAWINGS

FIG. 2 illustrates an example computing device for use in accordance with an embodiment of the present disclosure.

DETAILED DESCRIPTION

Figure 1:
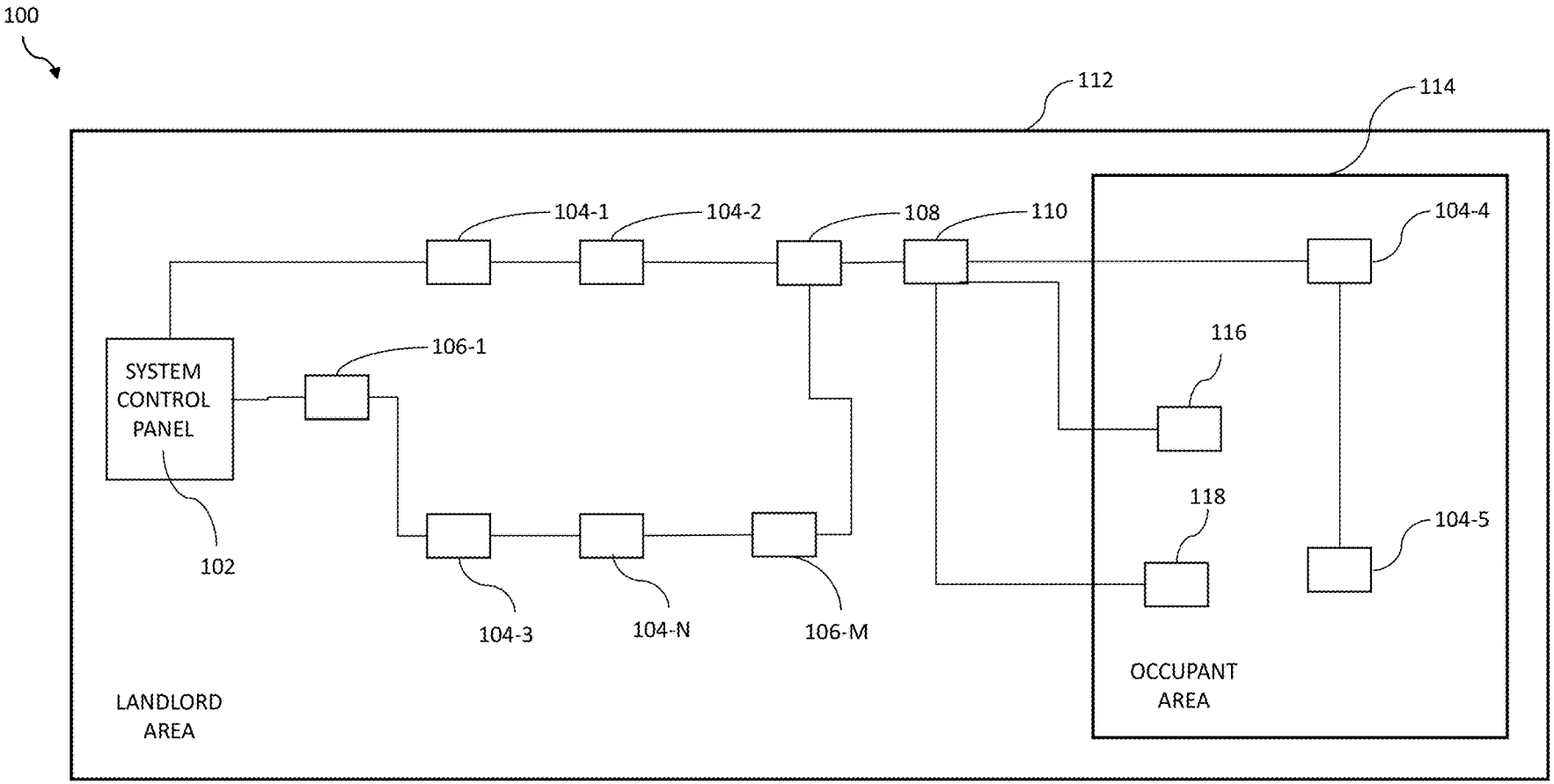
FIG. 1 illustrates an example alarming system for multi-unit buildings in accordance with an embodiment of the present disclosure.

Alarming systems for multi-unit buildings are described herein. Devices, systems, and methods for an alarming system for multi-unit buildings are described herein. One system includes a number of remote sensors positioned in a building having common areas and individual units occupied by occupants, the remote sensors are provided for sensing an alarm condition, a central control panel located in the common areas of the building for collecting data from the remote sensors, the control panel utilized for analyzing the collected data, determining whether to initiate an alarm, and sending one or more signals to initiate an alarm, if an alarm is to be initiated, and an occupant input device located in at least one individual unit for requesting a delay in initiating the alarm.

The multiple remote sensors are positioned in a building having common areas and individual units occupied by occupants, at least one of the remote sensors is provided in each, the common areas and individual units for sensing the alarm condition. The example embodiment also includes at least one local controller, located proximate to or within an individual unit having a processor and memory wherein the memory includes instructions executable by the processor for receiving data from one or more sensors within the individual unit, analyzing the received data, determining whether to initiate an alarm, and sending one or more signals to one or more alarm devices within the individual unit to initiate an alarm by the alarm devices, if an alarm is to be initiated.

The central control panel is located within the common areas of the building for collecting data from the remote sensors, the control panel having a processor and memory wherein the memory includes instructions executable by the processor for analyzing the collected data, determining whether to initiate an alarm, and sending one or more signals to one or more alarm devices to initiate an alarm by the alarm devices, if an alarm is to be initiated. The example embodiment also includes an occupant input device located in at least one individual unit for requesting a delay in initiating the alarm based on a request from either, the central control panel or the local control panel within the individual unit in which the occupant input device is located.

For example, one embodiment can be a field-bus powered local alarm controller for life safety systems. In such an embodiment, a local alarm controller is connected to, and loop powered from, an analogue addressable fire alarm panel.

A fire alarm system, as proposed in embodiments of the present disclosure, can include a fire alarm panel that controls an analogue addressable loop, which has a number of additional local alarm controllers connected to it, that provide local alarm control and status feedback to separate dwellings, from a common loop system.

In such an embodiment, the fire alarm panel is configured, so that fire alarm devices on the loop that are placed in each dwelling, are able to be controlled by each local alarm controller. Also, in such embodiments, a simple remote interface can be wired from each local alarm controller and is placed in each resident's dwelling.

Each resident is then able to control a number of fire alarm devices and other life safety devices which can then be placed within the dwelling, from the remote interface.

The loop devices in the dwelling, which may be multi-sensor fire detectors or other life safety devices can then be tested from the remote interface, causing them to generate a local test voice message and or alarm tone.

If a nuisance alarm occurs in a dwelling, for example by smoking cigarettes the smoke sensor in the multi-sensor fire detectors activates, then an alarm message and or alarm tone will be generated in the dwelling. The resident is then given a short time to set a local delay on this fire alarm event using the remote interface. During this local delay the alarms will stop, and as long as the smoke is cleared from the area before the end of the delay, then this event does not result in a fire alarm condition at the panel and a building evacuation will not occur.

Additionally, the resident may activate a local delay ahead of the multi-sensor fire detectors or other life safety devices activating. This may be pre-configured to be of a different delay time.

However, if more than one multi-sensor fire detector detects smoke or other fire phenomena, then this can override any local delay and result in a fire alarm condition at the panel.

At the panel, flexible delay times and complex fire processing can be pre-configured for each dwelling, so that different fire phenomena can be delayed by the resident, or so that an immediate fire alarm condition can occur with certain fire phenomena.

One aim of this system is to provide unambiguous clarity by using a voice feedback messages from the multi-sensor fire detectors or hazard devices in the dwelling. This enables the indication of the interface status, delay times, test conditions, local fire alarms, building evacuation alarms, other warnings or life safety alarms to be clearly differentiated.

It is also an aim to provide the building owner a warning about potential fire probabilities or other life safety events. In this case, a gateway is connected to the fire alarm panel, so the data from all dwellings can be collected from the fire panel and analyzed remotely. Reports and warning messages can then be sent to the building owner or other interested parties about the likelihood of possible fires or other problems.

Additionally, a digital assistant voice interface, allowing simple non-critical user voice commands, can be used in the dwelling to action the local tests and local delays.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 101 may reference element "01" in FIG. 1, and a similar element may be referenced as 201 in FIG. 2.

As used herein, "a", "an", or "a number of" something can refer to one or more such things, while "a plurality of" something can refer to more than one such things. For example, "a number of devices" can refer to one or more devices, while "a plurality of devices" can refer to more than one device. Additionally, the designators "M" and "N", as may be used herein, particularly with respect to reference numerals in the drawings, indicates that a number of the particular feature so designated can be included with a number of embodiments of the present disclosure. This number may be the same or different between designations.

FIG. 1 illustrates an example alarming system for multi-unit buildings in accordance with an embodiment of the present disclosure. In FIG. 1, the system 100 is provided within or surrounding (if a security condition exists outside the building where sensors associated with the system can identify the alarm condition) a monitored area 112 (an area having sensors that can sense an alarm condition), such as a building. The system 100 has multiple zones within the monitored area 112.

In the embodiment of FIG. 1, the monitored area 112 has two zones, a landlord area and an occupant area. In some implementations, the landlord area may be divided into multiple spaces (e.g., entry area, lobby, hallways, common rooms for use by all occupants, or other rooms under the control of the landlord). Additionally, in some implementations, there may be multiple occupant areas each having features as described herein.

Within the landlord area, a network of sensors and a control system operate to issue alarms when an alarm condition is sensed and the control system deems an alarm should be initiated. As used herein, an alarm condition can be the threat affecting the occupants of the building that is sensed by the sensors connected to the system 100. The sensors can include audio, visual, chemical, thermal, or smoke sensors that can identify threats to occupants, such as fires, excessive smoke, the presence of harmful chemicals (e.g., carbon monoxide), and other threats that can be detected by such sensor types.

In FIG. 1, the system 100 includes a control panel 102. For example, a control panel of a fire system, a control panel of an alarm system for another type of alarm system, or a general control panel that can identify a variety of threats would be suitable types of control panels that could be utilized in embodiments of the present disclosure.

The control panel is connected to a variety of other system components including sensors 104-1, 104-2, 104-3, 104-N, 108 and occupant actuatable mechanisms (also referred to herein as sensors since they are sensing an alarm condition, but are doing so by occupant sensing rather than device sensing) 106-1, 106-M. Sensor 108 is provided to indicate that a monitored area can have different types of sensors, such as sensors 104 being thermal sensors and sensor 108 being a smoke sensor. Any combination of sensors can be used in embodiments of the present disclosure.

As discussed above, the sensors can include audio, visual, chemical, thermal, or smoke sensors that can identify threats to occupants, such as fires, excessive smoke, the presence of harmful chemicals (e.g., carbon monoxide), and other threats that can be detected by such sensor types. The occupant actuatable mechanisms can be items such as fire alarm pulls that allow occupant to trigger the system even if the sensors do not sense a condition requiring an alarm to be initiated (e.g., in a situation where an occupant can be in immediate danger before the sensors can detect an alarm condition, such as a fire in a location near occupants, but remote from a sensor or where an area may not have a type of sensor to sense the threat to the occupant, such as a gas leak in an area that only has thermal sensors.

These sensors are connected to the control panel and provide data to a processor within the control panel that processes the data, via executable instructions stored in memory that are executed by the processor, to determine if the data indicates that a threat to occupants is present and that an alarm should be initiated. As used herein, an alarm can be audible, visual, or other sensory type that can be received by an occupant and interpreted to indicate that a threat to the occupant is present in the monitored area.

Any suitable process for determining a threat condition exists can be utilized in embodiments of the present disclosure. For example, for fire sensing, the presence of heat above a threshold level can be a determinative criterion for initiating an alarm that a fire threat is present in an area of the monitored area.

The sensor devices 104 and 108 can also include an alarm functionality. For example, the sensor devices can have a siren that can sound, a light that can illuminate, and/or other mechanism that can function to alert people within a landlord area that a threat condition is present in the monitored area. In some embodiments, the alarm functionality can be provided by separate alarm devices rather than that functionality being integrated into the sensing devices.

The system 100 also includes a junction 110 between the sensing system in the landlord areas of the monitored area 112 and the sensing system of the occupied areas 114. As used herein, an occupied area can be any area under the control of an occupant. This can include apartments within an apartment building, offices within an office building, patient rooms within a hospital, labs within a research facility, and other such areas where occupants will be present within a monitored area and where it may be desirable to have the occupant intercede to delay or block the initiation of an alarm if a condition in the occupant's area does not affect other parts of the monitored area and, therefore, an alarm to the whole monitored area is not necessary.

In some embodiments, the landlord area can be a first analog addressable loop and the occupant area can be a second analog addressable loop in which the loops communicate through the junction, thereby creating one large system of sensors with multiple loops. However, embodiments can be designed to be covered by other system configurations, such as a single common loop or a loop with spurs that are provided in occupant areas, among other suitable system shapes. In this manner, the large system can have one set of rules with respect to determining an alarm and can access all sensors of the system, but the one or more second loops can have some separate rules that apply to its sensors and feedback from the occupant with regard to initiating an alarm.

In FIG. 1, the occupant area 114 includes a number of sensing devices 104-4, 104-5. From the control panel 102's perspective, the sensing devices 104-4 and 104-5 are part of the overall monitored area 112's sensing array and any sensing data indicating a threat is treated the same as data from a sensor in the landlord area. However, when the data is received from the occupied area 114, the control panel that data is identified as coming from the occupied area 114.

The identification can, for example, be accomplished by including an identifier, such as a sensing device ID, an occupied area ID, junction ID, or other identifier with the data, or any other suitable identification method. This allows the system to also include the ability for the occupant of the area where the sensor data came from to intercede as discussed above.

The interceding by the occupant can be accomplished by actuating a mechanism 116 within the occupied area 114. The mechanism can be a switch on the wall of the occupied area 114 or other fixed or portable device that can be configured to send a signal to the control panel. The control panel can be configured to, once the signal is received from the occupant, delay or block the initiation of an alarm.

In some implementations, the delay or block can be implemented to delay or block the alarm from being initiated outside of the occupied area to which the alarm condition was sensed or can be implemented to delay or block the alarm from being initiated in all areas including the area to which the alarm condition was sensed. Such implementation decisions can be implemented, for example, by a system administrator when the system is set up or by the manufacturer. These decisions can, for example, be implemented by adjusting settings in the software running on the control panel 102 to change the duration of the delay and/or where the delay or block occurs.

Additionally, in some embodiments, the occupant area can include a voice communication mechanism 118 that allows for audio messages to be passed to the occupant area. This can be a speaker and the messages can be saved in the control panel and played when an alarm within the space indicates there is an alarm condition present in the occupant area. Further, in some embodiments, the alarm devices/sensors may have speakers and contain the voice messages stored in memory therein (i.e. 104-4 or 104-5).

For example, one message can be an instruction to block or delay the alarm in other areas by using the occupant intercede mechanism 116. Other instructions as to what the occupant should do (e.g., remain in the occupant area, go to a muster point) can also be presented to the occupant at the occupant area. In some implementations, each occupant can get different messages, wherein some occupants may receive a message to go to a muster point and others receive a message to remain in their occupant area, or other instruction.

Additionally, in some implementations, the occupant area may include a microphone (e.g., separate from or integrated into voice communication mechanism 118) and the occupant can speak to an alarm system administrator or can provide voice information to the control panel (e.g., "yes, initiate a five minute delay"). This can be beneficial if the occupant has special instructions to pass on regarding the occupant's status or status of the alarm condition (e.g., "we overcooked our dinner and there is smoke, but no fire. Please give us five minutes to clear the smoke", "there are five of us in this apartment and one is in a wheelchair and may need someone to carry them out if the elevator is not in service").

The present disclosure includes several different embodiments. Provided below are a few examples of embodiments to illustrate the different implementations that can be provided based on the specific application the system will be used for.

In one embodiment the alarming system for multi-unit buildings, includes a number of remote sensors positioned in a building having common areas and individual units occupied by occupants, the remote sensors are provided for sensing an alarm condition.

This embodiment also includes a central control panel located in the common areas of the building for collecting data from the remote sensors, the control panel having a processor and memory wherein the memory includes instructions executable by the processor for analyzing the collected data, determining whether to initiate an alarm, and sending one or more signals to initiate an alarm, if an alarm is to be initiated and an occupant input device located in at least one individual unit for requesting a delay in initiating the alarm.

In some embodiments, the system can also include wherein each individual unit includes an occupant input device. The occupant input device can, for example, be the occupant intercede mechanism 116 or the voice communication mechanism 118.

The occupant input device, when activated by an occupant and as implemented by the control panel, delays the activation of other alarm devices within the building for a period of time. The period of time can be a short time, like a matter of minutes, a long time, like a matter of hours, or can be indefinite (blocks the initiation of an alarm).

As discussed herein, in some implementations, the occupant input device, when activated by an occupant, deactivates the alarm device (blocks the alarm after initiation) in the individual unit in which the alarm device has been activated and/or delays the activation of other alarm devices within the building for a period of time. As discussed above, this delay can be short, long, or indefinite based on settings set, for example, by the administrator of the system of the manufacturer of the control panel.

The voice communication mechanism can be or include a speaker in at least one individual unit to broadcast voice instructions to the occupants of the individual unit (occupant area). This can additionally include a microphone in the at least one individual unit to allow the occupant to speak to an administrator of the system.

Further, the system can include an alarm device within each individual unit and this alarm device will activate an alarm if an alarm condition exists within the individual unit in which the alarm device is located. In some embodiments, alarm device having a speaker, a processor, and memory within each individual unit and this alarm device will activate, via the processor, to play a voice message, if an alarm condition exists within the individual unit in which the alarm device is located.

Another example of an alarming system for multi-unit buildings, includes a common loop alarm system having a central control panel communicating via an analogue addressable loop with multiple remote sensors for reporting an alarm condition. The multiple remote sensors are positioned in a building having common areas and individual units occupied by occupants, at least one of the remote sensors is provided in each, the common areas and individual units for sensing the alarm condition.

The system also includes at least one local control panel located proximate to or within an individual unit for receiving data from one or more sensors within the individual unit, analyzing the received data, and sending one or more signals to one or more alarm devices within the individual unit to initiate an alarm by the alarm devices, if an alarm is to be initiated. The local control panel can be a device such as that shown in FIG. 2 and can be used to communicate between the occupant and the central control panel.

It can be provided as 116 or 118 in FIG. 1 and include the functionality discussed with respect to item 116 and/or 118 of FIG. 1. The local control panel can be mounted in the individual unit or can be provided by a portable device such as a consumer universal remote or mobile phone.

The central control panel (alarm system control panel 102 of FIG. 1) is located within the common areas (landlord area 112 of FIG. 1) of the building for collecting data from the remote sensors for analyzing the collected data, determining whether to initiate an alarm, and sending one or more signals to one or more alarm devices to initiate an alarm by the alarm devices, if an alarm is to be initiated. The at least one occupant input device located in an individual unit for requesting a delay in initiating the alarm based on a request from either, the central control panel or the local control panel within the individual unit in which the occupant input device is located.

In some implementations, the occupant input device cannot request a delay in initiating an alarm that is determined to have been indicated by a sensor located in a common area of the building. This determination can be accomplished, for example, by the central control panel.

In another example, an alarming system embodiment for multi-unit buildings includes a common loop alarm system having a central control panel communicating via an analogue addressable loop with multiple remote sensors for reporting an alarm condition. This embodiment also includes the multiple remote sensors positioned in a building having common areas and individual units occupied by occupants, at least one of the remote sensors is provided in each, the common areas and individual units for sensing the alarm condition and at least one local controller, located proximate to or within an individual unit having a processor and memory wherein the memory includes instructions executable by the processor for receiving data from one or more sensors within the individual unit, analyzing the received data, determining whether to initiate an alarm, and sending one or more signals to one or more alarm devices within the individual unit to initiate an alarm by the alarm devices, if an alarm is to be initiated.

The central control panel in this example is located within the common areas of the building for collecting data from the remote sensors, the control panel having a processor and memory wherein the memory includes instructions executable by the processor for analyzing the collected data, determining whether to initiate an alarm, and sending one or more signals to one or more alarm devices to initiate an alarm by the alarm devices, if an alarm is to be initiated. And, an occupant input device located in at least one individual unit for requesting a delay in initiating the alarm based on a request from either, the central control panel or the local control panel within the individual unit in which the occupant input device is located.

As discussed herein, the sensors can be of any suitable type for sensing an alarm condition in the monitored area.

This includes, but is not limited to, audio sensors configured to sense a disturbance within the building, thermal sensors configured to sense a thermal issue occurring within the building, chemical sensors configured to sense a chemical issue within the building, and/or smoke sensors configured to sense a smoke issue within the building.

Each of the features of the embodiments discussed in this disclosure can provide benefits over the presently available systems. Such features can allow for better analysis of alarm conditions, less disruption for occupants, less false alarms for emergency responders, and other significant benefits.

FIG. 2 illustrates an example computing device for use in accordance with an embodiment of the present disclosure. Such a computing device can be used in or provided as the alarm system control panel 102 shown in FIG. 1.

Embodiments herein can include hardware, firmware, and/or logic that can perform a particular function. For instance, some embodiments include circuitry (e.g., diagnostic circuitry). As used herein, "logic" is an alternative or additional processing resource to execute the actions and/or functions, described herein, which includes hardware (e.g., various forms of transistor logic, application specific integrated circuits (ASICs)), as opposed to computer executable instructions (e.g., software, firmware) stored in memory and executable by a processing resource.

Such functions can be provided, for example, by the computing device of FIG. 2 which includes a computing device 220 having a processor 222 and memory 224. This can be in addition to, or in place of, a controller. As provided in FIG. 2, computing devices in accordance with the present disclosure can include a memory and a processor.

Memory can be any type of storage medium that can be accessed by the processor to perform various examples of the present disclosure. For example, the memory can be a non-transitory computer readable medium having computer readable instructions (e.g., computer program instructions) stored thereon that are executable by processor to receive and store data from the sensors of the system, analyze the data to determine if an alarm condition exists, and/or initiate an alarm and/or send messages to the occupants, in accordance with the present disclosure and as discussed herein. Stated differently, the processor can execute the executable instructions stored in the memory to perform these steps, and others, in accordance with the present disclosure.

Memory can be volatile or nonvolatile memory. Memory can also be removable (e.g., portable) memory, or non-removable (e.g., internal) memory. For example, memory can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory. Memory can be located in the computing device and/or can be located internal to another computing resource (e.g., enabling computer readable instructions to be downloaded over the Internet or another wired or wireless connection).

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure. It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. An alarming system for multi-unit buildings, comprising:

a number of remote sensors positioned in a building having common areas and individual units occupied by occupants, the remote sensors are provided for sensing an alarm condition;

a central control panel located in at least one of the common areas of the building for collecting data from the remote sensors, the control panel having a processor and memory wherein the memory includes instructions executable by the processor for analyzing the collected data, determining whether to initiate an alarm, and sending one or more signals to initiate an alarm, if an alarm is to be initiated; and an occupant input device located in at least one individual unit for requesting a delay in initiating the alarm, wherein the occupant input device cannot request a delay in initiating an alarm that is determined to have been indicated by a remote sensor located in one of the common areas of the building.

2. The system of claim 1, wherein each individual unit includes an occupant input device.

3. The system of claim 1, wherein the system further includes a speaker in at least one individual unit to broadcast voice instructions to the occupants of the individual unit.

4. The system of claim 3, wherein the system further includes a microphone in the at least one individual unit to allow an occupant to speak to an administrator of the system.

5. The system of claim 1, wherein the system includes an alarm device within each individual unit and this alarm device will activate an alarm if an alarm condition exists within the individual unit in which the alarm device is located.

6. The system of claim 5, wherein the occupant input device, when activated by an occupant, delays the activation of other alarm devices within the building for a period of time.

7. The system of claim 5, wherein the occupant input device, when activated by an occupant, deactivates the alarm device in the individual unit in which the alarm device has been activated and delays the activation of other alarm devices within the building for a period of time.

8. An alarming system for multi-unit buildings, comprising:

a common loop alarm system having a central control panel communicating via an analogue addressable loop with multiple remote sensors for reporting an alarm condition;

the multiple remote sensors positioned in a building having common areas and individual units occupied by occupants, at least one of the remote sensors is provided in each, the common areas and individual units for sensing the alarm condition;

at least one local controller, located proximate to or within an individual unit for receiving data from one or more sensors within the individual unit, analyzing the received data, and sending one or more signals to one or more alarm devices within the individual unit to initiate an alarm by the alarm devices, if an alarm is to be initiated;

the central control panel located within at least one of the common areas of the building for collecting data from the remote sensors for analyzing the collected data, determining whether to initiate an alarm, and sending one or more signals to one or more alarm devices to initiate an alarm by the alarm devices, if an alarm is to be initiated; and at least one occupant input device located in an individual unit for requesting a delay in initiating the alarm based on a request from either, the central control panel or a local control panel within the individual unit in which the occupant input device is located, wherein the at least one occupant input device cannot request a delay in initiating an alarm that is determined to have been indicated by a remote sensor located in one of the common areas of the building.

9. The system of claim 8, wherein each individual unit includes an occupant input device.

10. The system of claim 8, wherein the system further includes a speaker in at least one individual unit to broadcast voice instructions to the occupants of the individual unit.

11. The system of claim 10, wherein the system further includes a microphone in the at least one individual unit to allow an occupant to speak to an administrator of the system.

12. The system of claim 8, wherein the system includes an alarm device having a speaker, a processor, and memory within each individual unit and this alarm device will activate, via the processor, to play a voice message, if an alarm condition exists within the individual unit in which the alarm device is located.

13. The system of claim 12, wherein the occupant input device, when activated by an occupant, delays the activation of other alarm devices within the building for a period of time.

14. The system of claim 12, wherein the occupant input device, when activated by an occupant, deactivates the alarm device in the individual unit in which the alarm device has been activated and delays the activation of other alarm devices within the building for a period of time.

15. An alarming system for multi-unit buildings, comprising:

a common loop alarm system having a central control panel communicating via an analogue addressable loop with multiple remote sensors for reporting an alarm condition;

the multiple remote sensors positioned in a building having common areas and individual units occupied by occupants, at least one of the remote sensors is provided in each, the common areas and individual units for sensing the alarm condition;

at least one local controller, located proximate to or within an individual unit having a processor and memory wherein the memory includes instructions executable by the processor for receiving data from one or more sensors within the individual unit, analyzing the received data, determining whether to initiate an alarm, and sending one or more signals to one or more alarm devices within the individual unit to initiate an alarm by the alarm devices, if an alarm is to be initiated;

the central control panel located within at least one of the common areas of the building for collecting data from the remote sensors, the control panel having a processor and memory wherein the memory includes instructions executable by the processor for analyzing the collected data, determining whether to initiate an alarm, and sending one or more signals to one or more alarm devices to initiate an alarm by the alarm devices, if an alarm is to be initiated; and an occupant input device located in at least one individual unit for requesting a delay in initiating the alarm based on a request from either, the central control panel or a local control panel within the individual unit in which the occupant input device is located, wherein the occupant input device cannot request a delay in initiating an alarm that is determined to have been indicated by a remote sensor located in one of the common areas of the building.

16. The system of claim 15, wherein the remote sensors are audio sensors configured to sense a disturbance within the building.

17. The system of claim 15, wherein the remote sensors are thermal sensors configured to sense a thermal issue occurring within the building.

18. The system of claim 15, wherein the remote sensors are chemical sensors configured to sense a chemical issue within the building.

19. The system of claim 15, wherein the remote sensors are smoke sensors configured to sense a smoke issue within the building.

* * * * *